US005147172A

United States Patent [19]

Hosseini

[11] Patent Number: 5,147,172

[45] Date of Patent: Sep. 15, 1992

[54] AUTOMATIC RIDE CONTROL

[75] Inventor: Javad Hosseini, Peoria, Ill.

[73] Assignee: Caterpillar Inc., Peoria, Ill.

[21] Appl. No.: 753,552

[22] Filed: Sep. 3, 1991

[51] Int. Cl.[5] ..... E02F 3/04

[52] U.S. Cl. ..... 414/719; 60/413; 414/699; 414/786

[58] Field of Search ..... 414/680, 685, 673, 699, 414/719, 786; 212/261; 280/707, 714; 60/413

[56] References Cited

U.S. PATENT DOCUMENTS

| | | | |
|---|---|---|---|
| 2,526,500 | 10/1950 | Pilch | 414/719 X |
| 2,672,995 | 3/1954 | Drott | 414/715 |
| 3,122,246 | 2/1964 | Freedy et al. . | |
| 3,872,670 | 3/1975 | Dezelan et al. | 60/413 |
| 3,912,227 | 10/1975 | Meekes et al. | 60/413 X |
| 3,949,892 | 4/1976 | Ohms | 414/635 |
| 3,953,040 | 4/1976 | Unruh et al. . | |
| 4,341,149 | 7/1982 | Dezelan | 60/413 X |
| 4,953,723 | 9/1990 | Saotome et al. | 60/413 X |
| 4,969,562 | 11/1990 | Saotome | 60/413 X |
| 4,995,517 | 2/1991 | Saotome | 60/413 X |
| 5,034,892 | 7/1991 | Saotome | 60/413 X |

FOREIGN PATENT DOCUMENTS

| | | | |
|---|---|---|---|
| 1-256494 | 10/1989 | Japan | 212/261 |
| 1076549 | 2/1984 | U.S.S.R. | 414/699 |

*Primary Examiner*—Robert J. Spar
*Assistant Examiner*—William M. Hienz
*Attorney, Agent, or Firm*—Steve R. Janda

[57] ABSTRACT

Work vehicles are used to perform a variety of functions. Advantageously, such work vehicles include systems for cushioning the ride while the vehicle is travelling. The subject automatic ride control senses the speed of the vehicle and responsively activates and deactivates the ride control by respectively connecting and disconnecting an accumulator to the lift cylinder hydraulic circuit.

8 Claims, 2 Drawing Sheets

AUTOMATIC RIDE CONTROL

DESCRIPTION

1. Technical Field

This invention relates generally to an apparatus and method for engaging and disengaging a ride control on a work vehicle, and more particularly, to an apparatus and method for controllably engaging and disengaging a ride control on a work vehicle having a hydraulic lift cylinder for moving an implement.

2. Background Art

Vehicles such as wheel type loaders include work implements capable of being moved through a number of positions during a work cycle. Such implements typically include buckets, forks, and other material handling apparatus. The typical work cycle associated with a bucket includes filling the bucket with material, carrying the material to a dump site, and dumping the material from the bucket.

Vehicles of this type generally do not include shock-absorbing suspension systems. Thus as the vehicle is travelling, the forces exerted on the vehicle by the terrain cause the vehicle to pitch and/or bounce which results in considerable operator discomfort and increased wear on the vehicle.

When the lift cylinders are rigidly maintained in position while the vehicle is travelling, the bucket and lift arm assembly move in connection with the pitching and bouncing of the vehicle. The substantial mass of the bucket and lift arm assembly, particularly when the bucket is filled with material, tends to exacerbate the effects of the pitching and bouncing.

In an effort to reduce the effects of these forces, hydraulic accumulators have been added to the lift cylinder hydraulic circuit. Such an arrangement is disclosed in U.S. Pat. No. 3,122,246, issued to Freedy et al. on Feb. 25, 1964. This arrangement allows hydraulic fluid to flow from the head end of the lift cylinder to an accumulator and from the rod end of the lift cylinder to a fluid reservoir.

Thus when the vehicle is pitching, the forces that would otherwise be transferred to the lift arm assembly and bucket through the lift cylinders are absorbed by the accumulator. In this way, the lift arm assembly and bucket tend to be isolated from the pitching and bouncing of the vehicle. Since the mass of the lift arm assembly and bucket is not involved in the pitching and bouncing, the effects on the vehicle are lessened.

However, when the vehicle is loading material into the bucket, substantially all of the forces produced by the drive train of the vehicle should be transferred to the bucket. If the accumulator is connected to th lift cylinder while the vehicle is loading material in the bucket, much of the force needed to fill the bucket with material will be absorbed by the accumulator. The resulting loss of force applied to the bucket causes reduced loading performance.

To address this problem, the Freedy et al. patent discloses a manual switch for opening and closing a valve between the lift cylinders and the accumulator. The manual switch, however, requires operator attention each time the valve is opened or closed.

The present invention is directed at overcoming one or more of the problems as set forth above.

DISCLOSURE OF THE INVENTION

The invention avoids the disadvantages of known ride control systems and provides a system for controllably connecting a hydraulic accumulator to a lift cylinder in response to the vehicle operating at a carry speed and disconnecting the hydraulic accumulator from the lift cylinder in response to the vehicle operating at a loading or dumping speed.

In one aspect of the present invention, a ride control is provided for a vehicle having an implement and a hydraulic lift cylinder for moving the implement to and between a plurality of positions. The ride control includes a velocity sensor, a hydraulic accumulator, and a control valve connected to and between the hydraulic accumulator and the lift cylinder. When the control valve is open, hydraulic fluid passes between said lift cylinder and said hydraulic accumulator. When the control valve is closed, hydraulic fluid is prevented from passing between the lift cylinder and the hydraulic accumulator. The ride control opens the control valve in response to the velocity signal being greater than a first predetermined magnitude and closes the control valve in response to the velocity signal being less than a second predetermined magnitude.

In another aspect of the present invention, a method is provided for controllably engaging and disengaging a ride control in a vehicle having an implement and a hydraulic lift cylinder for moving the implement to and between a plurality of positions. The method includes the steps of sensing a velocity of the vehicle and responsively producing a velocity signal, producing a first electrical signal in response to the velocity signal being greater than a first predetermined magnitude, producing a second electrical signal in response to the velocity signal being less than a second predetermined magnitude, allowing fluid to flow between a hydraulic accumulator and the lift cylinder in response to said first electrical signal, and preventing fluid from flowing between the hydraulic accumulator and the lift cylinder in response to the second electrical signal.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
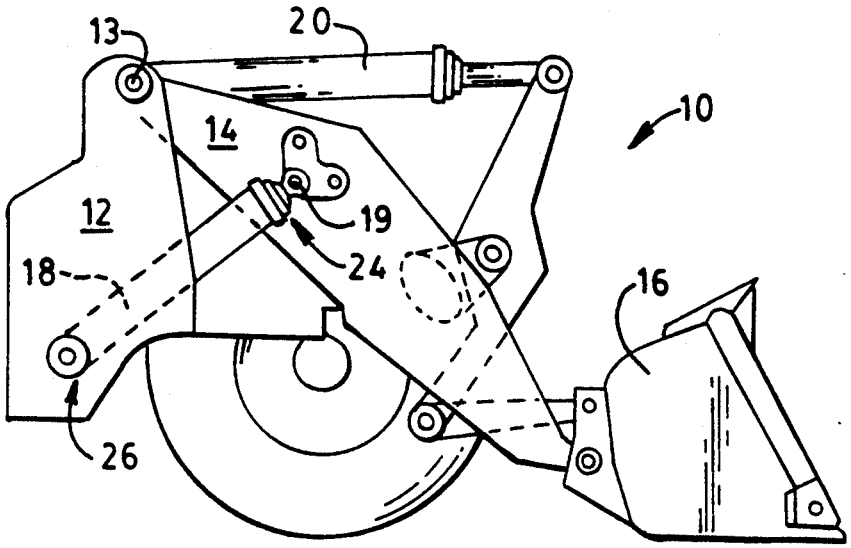
FIG. 1 is a side view of a front portion of a loader vehicle embodying the present invention.

In FIG. 1 an automatic ride control is generally represented by the element number 10. Although FIG. 1 shows a forward portion of a wheel type loader vehicle 12 having a payload carrier in the form of a bucket 16, the present invention is equally applicable to vehicles such as track type loaders and other vehicles having similar implements. The bucket 16 is connected to a lift arm assembly 14, which is pivotally actuated by two hydraulic lift cylinders 18 (only one of which is shown) about a pair of lift arm pivot pins 13 (only one shown) attached to the vehicle frame. Each lift cylinder 18 includes a rod end 24 and a head end 26. A pair of lift arm load bearing pivot pins 19 (only one shown) are attached to the lift arm assembly 14 and the lift cylinders 18. The bucket 16 can also be tilted by a bucket tilt cylinder 20.

Figure 2:
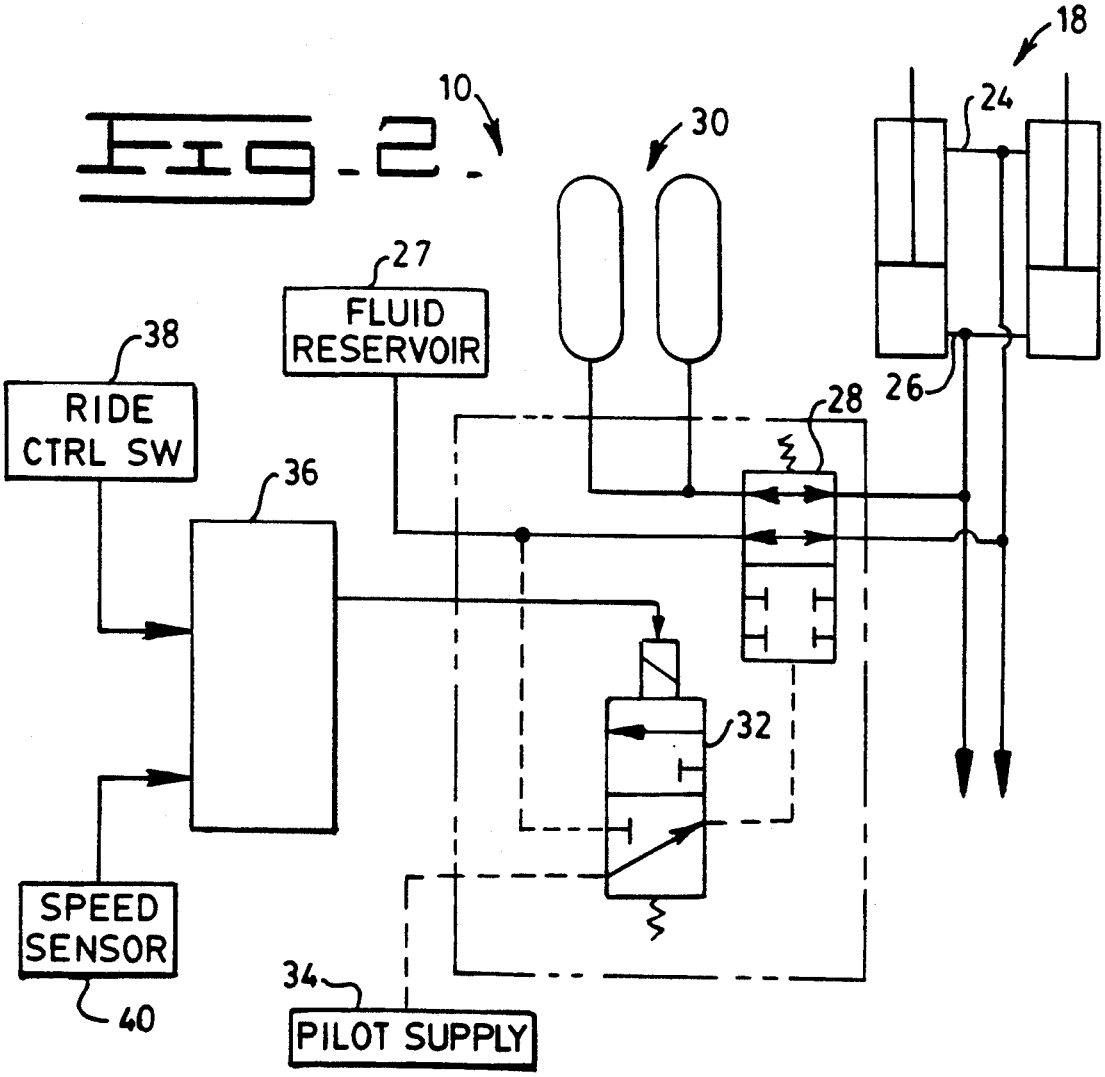
FIG. 2 is a diagrammatic view of an embodiment of the present invention.

Referring now to FIG. 2, the lift cylinders 18 are shown in connection with a hydraulic circuit. The rod end 24 and head end 26 of each lift cylinder 18 are connected to a hydraulic implement valve (not shown) via hydraulic circuitry. The hydraulic implement valve is of a type well-known in the art for controllably extending and retracting a hydraulic cylinder and will not be further discussed.

The rod end 24 is connected to a fluid reservoir 27 via a control valve 28. The head end 26 is connected to a pair of accumulators 30 via the control valve 28. While the preferred embodiment includes two accumulators 30, it should be appreciated that many systems embodying the present invention may require more or less than two depending on the size and capacity of the associated hydraulic system.

The control valve 28 is advantageously a pilot operated valve of a type well-known in the art and is controllably opened and closed in response to a hydraulic pilot signal from an electrohydraulic pilot valve 32. When the control valve 28 is open, hydraulic fluid is allowed to pass between the rod end 24 and the accumulators 30 and between the head end 26 and the fluid reservoir 27. When the control valve 28 is closed, hydraulic fluid is prevented from passing between the rod end 24 and the accumulators 30 and between the head end 26 and the fluid reservoir 27.

The electrohydraulic pilot valve 32 is advantageously in hydraulic communication with the control valve 28 and a pilot supply 34 and in electrical communication with a controller 36. The electrohydraulic pilot valve 32 directs pressurized fluid from the pilot supply 34 to the control valve 28 in response to receiving a "close" control signal from the controller 36. When the electrohydraulic pilot valve 32 receives an "open" control signal from the controller 36, pressurized fluid is prevented from flowing between the pilot supply 34 and the control valve 28.

In the preferred embodiment, the control valve 28 is closed (as described above) in response to receiving the hydraulic pilot signal from the electrohydraulic pilot valve 32 and is open (as described above) in response to the electrohydraulic pilot valve 32 preventing the hydraulic pilot signal from reaching the control valve 28. It should be appreciated, however, that control valves which open in response to receiving the hydraulic pilot signal and close in response to the electrohydraulic pilot valve 32 preventing the hydraulic pilot signal from reaching the control valve 28 would also be operable in connection with the present invention.

While the control valve 28 is described as a pilot operated valve, it should also be understood that the control valve 28 may take the form of an electrohydraulic valve which receives electrical control signals directly from the controller 36.

The controller 36 is in electrical communication with a ride control switch 38 and a vehicle speed sensor 40. The ride control switch 38 is typically mounted at the operator station of the vehicle 12 and has an "on" state in which the automatic ride control 10 is enabled and an "off"state in which the automatic ride control 10 is disabled.

The speed sensor 40 is preferably connected to the vehicle transmission (not shown) and produces a velocity signal indicative of the angular velocity of the transmission output shaft. As is known to one skilled in the art, a signal representing the angular velocity of the transmission output can be easily converted to represent the speed of the vehicle by multiplying the angular velocity by a simple conversion factor. The precise conversion factor is dependent upon the specifications of the vehicle of interest, e.g. the size of the differential reduction gear, the final drive, the rolling radius of the tires. It should be appreciated, however, that the particular form of the speed sensor 40 is not essential to the operation of the present invention. For example, speed sensors connected to the wheels of the vehicle would also be operable with the present invention.

Figure 3:
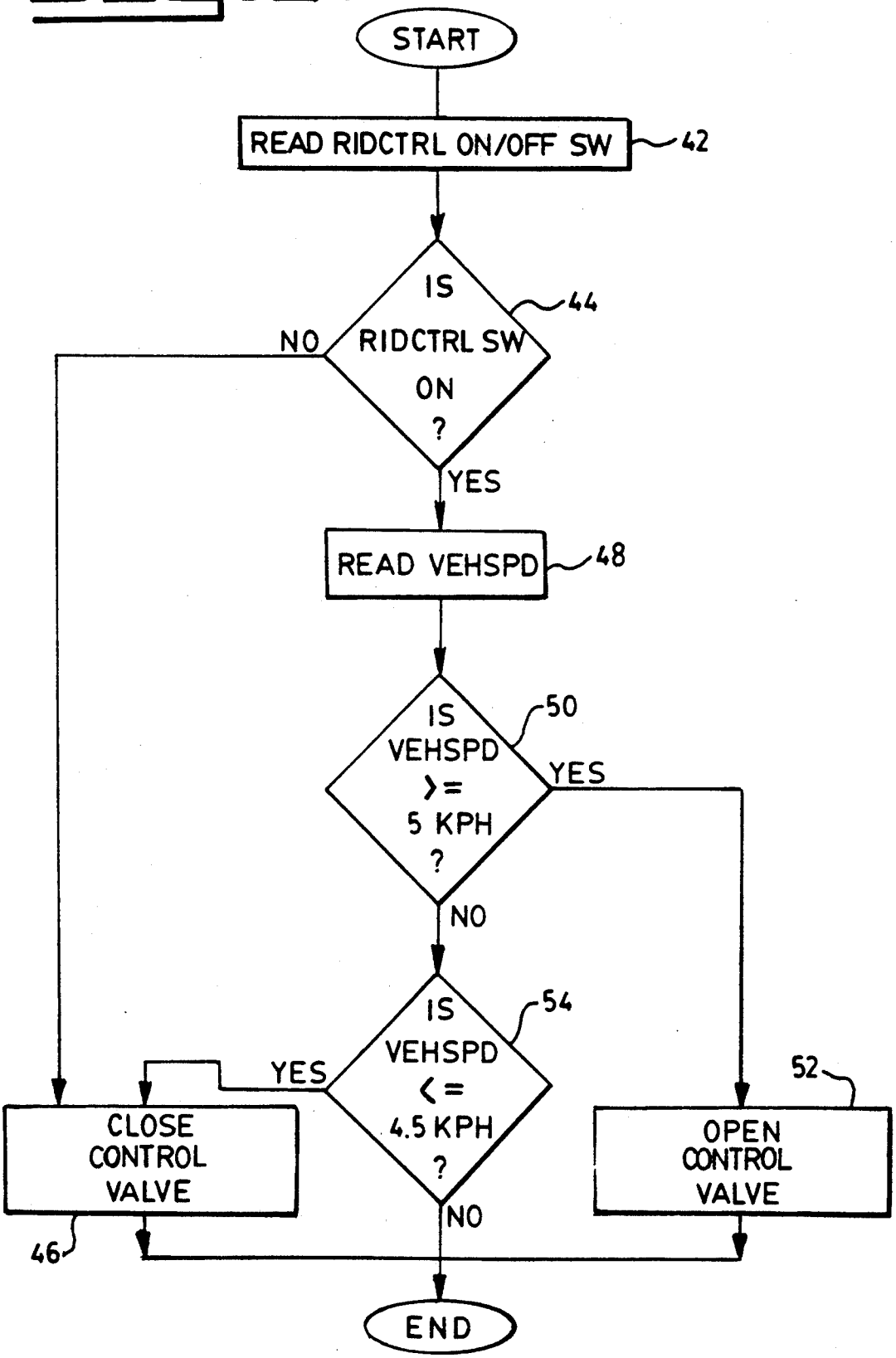
FIG. 3 is a block diagram illustrating the function of a portion of an embodiment of the present invention.

Referring primarily to FIG. 3, the function of the controller 36 is generally illustrated. The controller 36 reads 42 the signal from the ride control switch 38 and determines 44 whether the ride control switch 38 is in the "on" state or the "off"state. If the ride control switch 38 is in the "off"state, the controller 36 sends 46 the "close" control signal to the electrohydraulic valve 32 which responsively directs pressurized fluid to the control valve 28 and closes the control valve 28.

If the ride control switch 38 is in the "on"state, the controller 36 reads 48 the velocity signal from the speed sensor 40 and determines 50 whether the received velocity signal corresponds to the vehicle travelling at a speed greater than or equal to 5 kilometers per hour (KPH). If the vehicle speed is greater than or equal to 5 KPH, the controller 36 delivers 52 the "open" control signal to the electrohydraulic valve 32 which responsively prevents pressurized fluid from flowing between the pilot supply 34 and the control valve 28 which opens the control valve 28.

If the vehicle speed is less than 5 KPH, the controller 36 determines whether the received velocity signal corresponds to the vehicle travelling at a speed less than or equal to 4.5 KPH. If the vehicle speed is greater than 4.5 KPH, the algorithm is exited without taking further action. If the vehicle speed is less than or equal to 4.5 KPH, the controller 36 delivers the "close" control signal to the electrohydraulic valve 32 which responsively directs pressurized fluid to the control valve 28 and closes the control valve 28.

By activating the ride control when the vehicle speed reaches 5 KPH but not deactivating the ride control until vehicle speed falls below 4.5 KPH, a hysteresis effect is produced. If the ride control was activated and deactivated in response to the same vehicle speed, the ride control would be repeatedly activated and deactivated when the vehicle was travelling at substantially that chosen speed since the signal from the speed sensor is likely to vary over a given range. The present invention prevents such a contingency by activating the ride control in response to the vehicle speed reaching a first predetermined speed, but not deactivating the ride control until the speed is substantially reduced.

The speeds that are chosen for activating and deactivating the ride control are selected in response to the typical speeds at which the vehicle is moving while it is performing the various functions of the work cycle. Since the vehicle is typically moving slowly while the bucket is being loaded, it is advantageous to deactivate the ride control while travelling at these low speeds so that the maximum amount of force can be transferred from the vehicle drive train to the bucket. When the vehicle is travelling at relatively high speeds, the ride control is advantageously activated to increase operator comfort and reduce vehicle wear. While 5 KPH and 4.5

KPH were selected for the preferred embodiment, it should be appreciated that the precise values are a matter of design choice. The range between the speeds chosen to activate and deactivate the ride control is also a matter of design choice.

Industrial Applicability

The present invention is particularly useful in connection with work vehicles that perform a variety of functions such as loading and carrying material. In many applications, the range of ground speeds at which the vehicle is travelling during the loading function is substantially different from the range of ground speeds associated with the carrying function.

Since a ride control feature provides significant advantages to such a vehicle while performing the carrying function but includes substantial drawbacks while the vehicle is performing the loading function, the automatic ride control of the instant invention is provided to automatically activate and deactivate the ride control in response to vehicle speed. While the vehicle is travelling at the speeds associated with the carrying function, the ride control is activated; and while the vehicle is travelling at speeds associated with the loading function, the ride control is deactivated. Since the ride control is automatically activated and deactivated, operator workload and fatigue are reduced thus improving operator performance.

In addition to the loading function, it is also advantageous to deactivate the ride control when the vehicle is operating in confined spaces to prevent unwanted movement of the lift arms. However, since the vehicle is typically travelling at low speeds while operating in such confined spaces and the instant invention deactivates the ride control when the vehicle is travelling at low speeds, the instant invention automatically deactivates the ride control when the vehicle is operated in confined spaces.

Any specific values used in the above descriptions should be viewed as exemplary only and not as limitations. Other aspects, object, and advantages of this invention can be obtained from a study of the drawings, the disclosure, and the appended claims.

I claim:

1. A ride control for a vehicle having an implement and a hydraulic lift cylinder for moving the implement to and between a plurality of positions, comprising:

means for sensing a velocity of the vehicle and responsively producing a velocity signal;

a hydraulic accumulator;

a control valve connected to and between said hydraulic accumulator and the lift cylinder, said control valve having an open state in which hydraulic fluid passes between the lift cylinder and said hydraulic accumulator and a closed state in which hydraulic fluid is prevented from passing between the lift cylinder and said hydraulic accumulator; and means for opening said control valve in response to said velocity signal being greater than a first predetermined magnitude and closing said control valve in response to said velocity signal being less than a second predetermined magnitude.

2. A ride control, as set forth in claim 1, wherein the means for opening and closing said control valve includes:

a pilot valve means for delivering a hydraulic pilot signal to said control valve; and a controller for receiving said velocity signal and responsively delivering an electrical signal to said pilot valve means.

3. A ride control, as set forth in claim 1, including a switchable means for closing said control valve in response to operator input.

4. A ride control, as set forth in claim 1, wherein said first and second predetermined magnitudes are substantially equivalent.

5. A ride control for a vehicle having an implement and a hydraulic lift cylinder for moving the implement to and between a plurality of positions, comprising:

means for sensing a velocity of the vehicle and responsively producing a velocity signal;

a hydraulic accumulator;

a control valve connected to and between said hydraulic accumulator and the lift cylinder, said control valve having an open state in which hydraulic fluid passes between the lift cylinder and said hydraulic accumulator and a closed state in which hydraulic fluid is prevented from passing between the lift cylinder and said hydraulic accumulator;

a pilot valve in hydraulic communication with said control valve; and a controller for receiving said velocity signal and delivering a first electrical signal to said pilot valve in response to said velocity signal being greater than a first predetermined magnitude and a second electrical signal to said pilot valve in response to said velocity signal being less than a second predetermined magnitude.

6. A method for controllably engaging and disengaging a ride control in a vehicle having an implement and a hydraulic lift cylinder for moving the implement to and between a plurality of positions, comprising the steps of:

sensing a velocity of the vehicle and responsively producing a velocity signal;

producing a first electrical signal in response to the velocity signal being greater than a first predetermined magnitude;

producing a second electrical signal in response to the velocity signal being less than a second predetermined magnitude;

allowing fluid to flow between a hydraulic accumulator and the lift cylinder in response to said first electrical signal; and preventing fluid from flowing between the hydraulic accumulator and the lift cylinder in response to the second electrical signal.

7. A method, as set forth in claim 6, wherein said step of allowing fluid to flow includes producing a first hydraulic pilot signal and said step of preventing fluid from flowing includes the step of producing a second hydraulic pilot signal.

8. A method, as set forth in claim 6, wherein said first and second predetermined magnitudes are substantially equivalent.

* * * * *